US006238242B1

(12) United States Patent
Hwang

(10) Patent No.: US 6,238,242 B1
(45) Date of Patent: May 29, 2001

(54) PANEL-MOUNT CONNECTOR

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/596,793

(22) Filed: Jun. 19, 2000

(51) Int. Cl.[7] ..... H01R 13/73
(52) U.S. Cl. ..... 439/545; 439/557
(58) Field of Search ..... 439/347, 350, 439/351, 352, 353, 355, 357, 358, 545, 557

(56) References Cited

U.S. PATENT DOCUMENTS 5,830,008 * 11/1998 Broschard, III ..... 439/557
5,895,289 * 4/1999 Smith ..... 439/553
5,980,313 * 11/1999 Kunishi et al. ..... 439/545

* cited by examiner

*Primary Examiner*—Neil Abrams
*Assistant Examiner*—Michael C. Zarroli
(74) *Attorney, Agent, or Firm*—Wei Te Chung

(57) ABSTRACT

An electrical system comprises a computer enclosure having at least a panel thereof and which defines an opening with a pair of retaining lugs extending from edges of the opening. A connector is adapted to be assembled to the panel and includes a housing with a mating portion aligned to the opening. The housing includes a front flange portion engaged with the retaining lugs when the connector is assembled to the panel. An interlocking device arranged between the panel and the housing, which includes locking arms extending from the housing toward the panel, and a cutout formed on the retaining lug for engagement with a free end of each locking arm.

16 Claims, 9 Drawing Sheets

PANEL-MOUNT CONNECTOR

FIELD OF THE INVENTION

The present invention relates to a connector, and more particularly to a panel-mount connector with is incorporated with interlocking device to facilitate quick engagement and disengagement to a panel of a computer enclosure.

DESCRIPTION OF THE PRIOR ART

Many conventional connector assemblies mounted to a panel of an electric instrument like a computer chassis have been introduced to the market. One typical one is disclosed in U.S. Pat. Nos. 4,820,180; 4,988,308; 5,017,151; 5,049,092; 5,249,982; 5,514,000; 5,525,074; 5,575,673; 5,632,648; 5,766,041; 5,895,289; 5,931,688 and RE 34,430. The connector utilizes a claw-like or sealed securing structure to facilitate the attachment of the connector to the panel. Most of the sealed securing structures are additionally incorporated to interpose between the corresponding connector and the panel, beside several complementary structures formed in both the connector and panel. However, many different parts have been involved and thereby complicating the fabrication and the assembly to have the mass manufacture difficult and costly. Further, this first typical connector basically lacks an efficient and convenient releasing structure with regard to the panel. A permanent deformation/damage usually happens in such a securing structure, i.e. a claw-like structure, during the process of forcedly releasing the connector form the panel.

Another typical connector is disclosed in U.S. Pat. Nos. 4,678,259; 5,228,865; 5,254,010; 5,709,569; 5,733,142; 5,772,471; 5,924,877 and Des. 415,106. The second typical connector includes a direct-screwed attachment of the connector to the panel for enhancing the retention. However, manual alignments are required when attaching the connector to the panel and which requires laborious and costly job.

A third typical connector is disclosed in U.S. Pat. No. 5,766,035 and which includes two lugs 8a, 8b for aligning the connector with the panel before engagement. However, the corresponding mating connector must be specially incorporated with two screws. The standard connectors without additional screws are not suitable for mating with the third type connector. Also, the screws are possibly lost during delivery.

SUMMARY OF THE INVENTION

It is an object of this invention to provide a cable assembly which can be quickly and efficiently engaged and disengaged to a panel.

In order to achieve the object set forth, an electrical system comprises a computer enclosure having at least a panel thereof and which defines an opening with a pair of retaining lugs extending from edges of the opening. A connector is adapted to be assembled to the panel and includes a housing with a mating portion aligned to the opening. The housing includes a front flange portion engaged with the retaining lugs when the connector is assembled to the panel. An interlocking device arranged between the panel and the housing includes a locking arm extending from the housing toward the panel, and a cutout formed on the retaining lug for engagement with a free end of the locking arm.

According to an aspect of the present invention, the retaining lugs extends in parallel to a plane defined by the panel thereby defining a gap for fixedly receiving the front flange of the housing therein.

According to another aspect of the present invention, the retaining lugs extends rearward from edges of the opening and extending through passages defined in the front flange of the housing.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENTS

Figure 1:
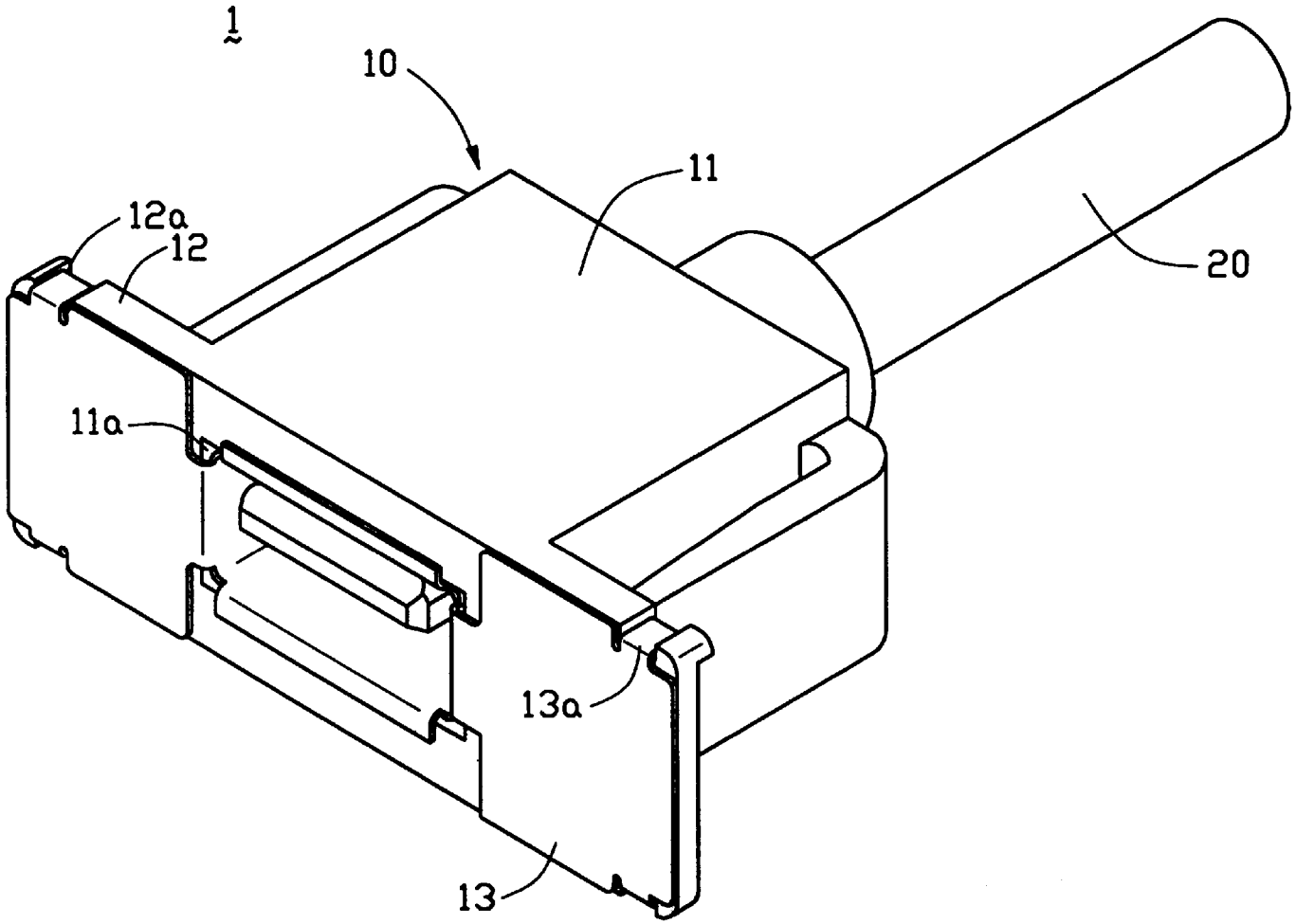
FIG. 1 is a perspective view of a cable assembly in accordance with the present invention.
Figure 2:
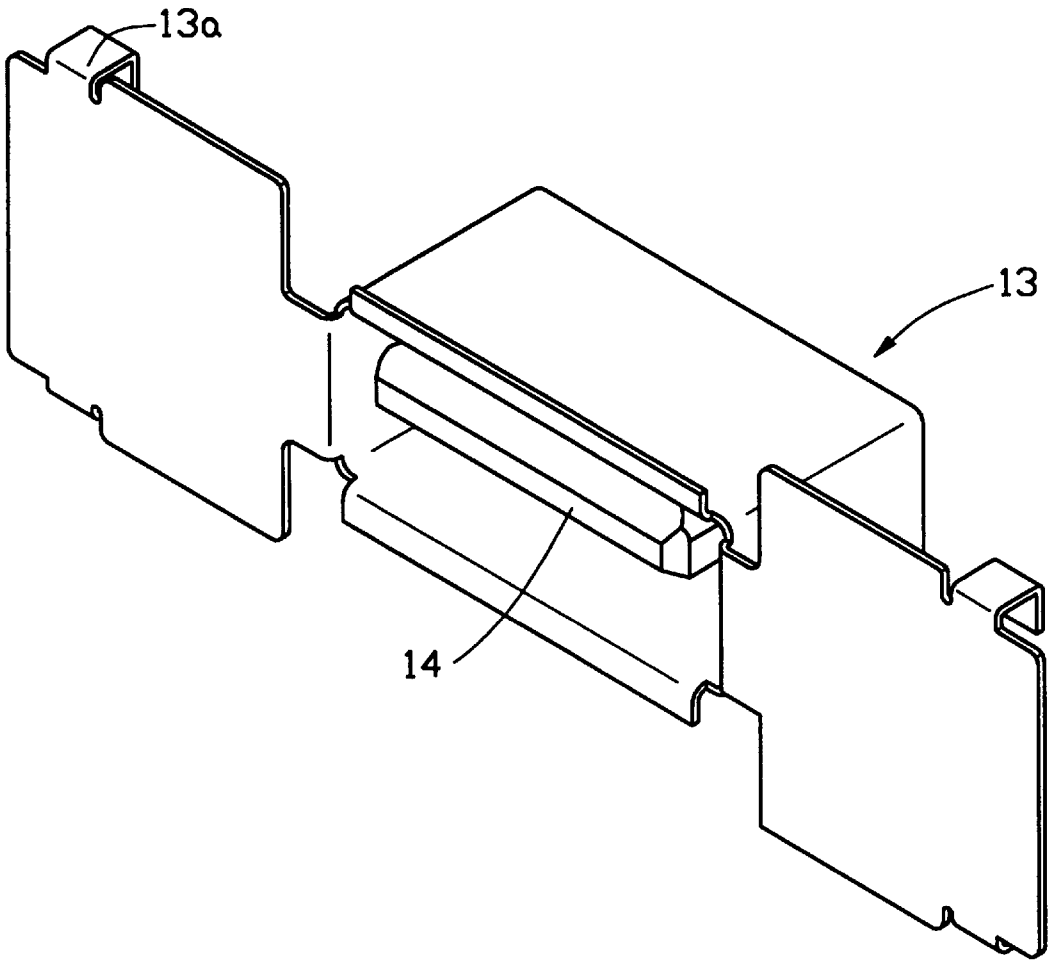
FIG. 2 is a perspective view of a metal shell in accordance with the present invention.
Figure 3:
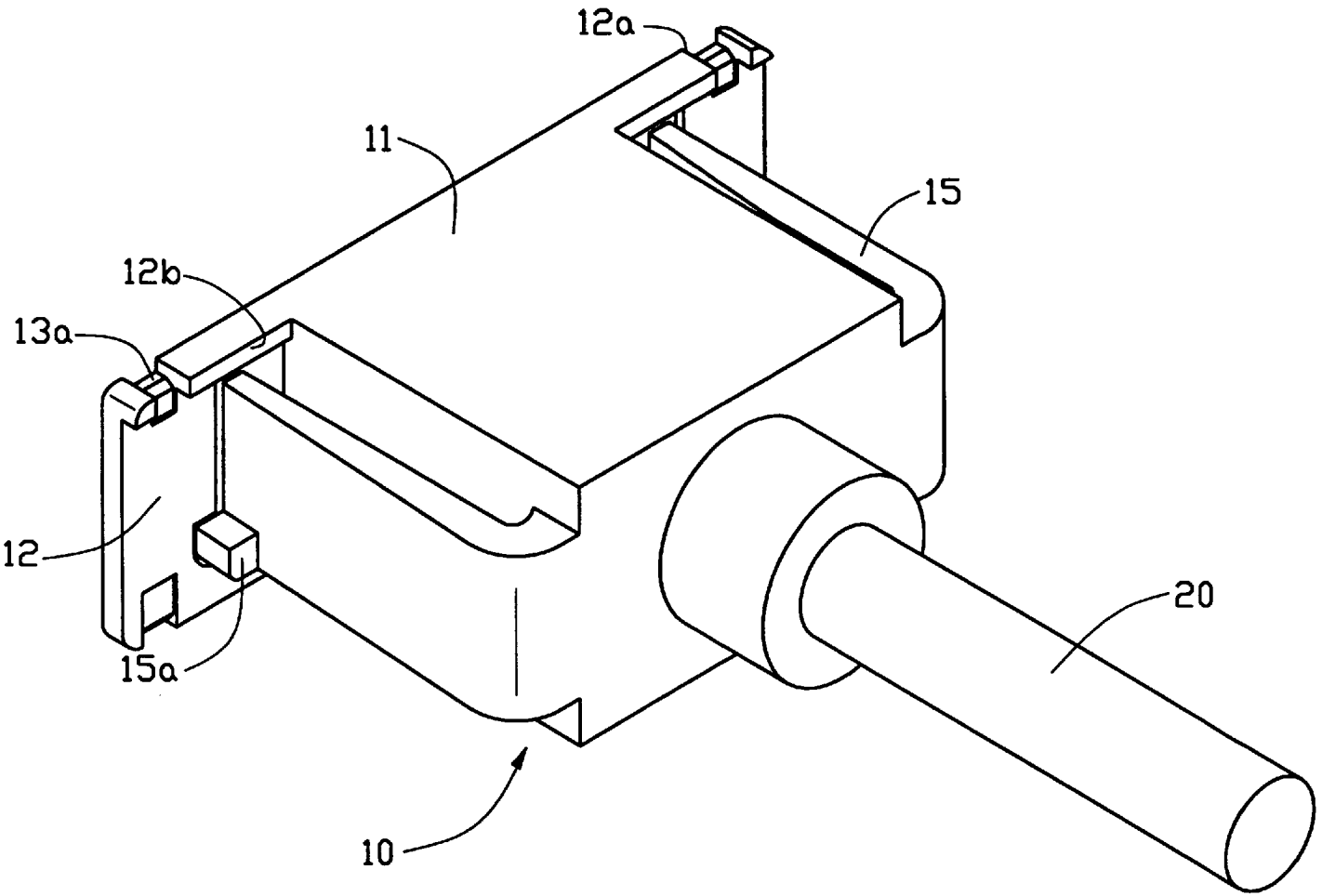
FIG. 3 is a rear view of a cable assembly of FIG. 1.

Referring to FIGS. 1 to 5, a cable assembly 1 in accordance with the present invention generally comprises a connector 10 and a cable 20 attached thereto. The connector 10 includes a housing 11 defining a receiving space 11*a* therein. The housing 11 further includes a front flange 12 extending transversely therefrom. A metal shell 13 is assembled to the housing 11. The metal shell 13 includes retaining tangs 13*a* fixedly clamped to notches 12*a* of the front flange 12. FIG. 2 is a perspective view of the metal shell 13. The metal shell 13 is also integrally integrated with a terminal piece 14 which is connected to the cable 20 (not detailedly shown). A stop 12*b* extends rearward from the front flange 12.

A pair of locking arms 15 extends from the housing 11 in a rear-to-front direction. Each locking arm 15 further includes a locking bud 15*a* at a free end thereof.

A computer enclosure panel 30 defines an opening 31 thereof. A pair of retaining lugs 32 extends from the panel 30. The retaining lugs 32 extend in a direction which is in parallel and offset to the panel 30. Accordingly, a gap 33 is defined between the retaining lugs 32 and the panel 30. In addition, each retaining lug 32 forms a cutout 34 at a free end 32*a* thereof.

When the cable assembly 1 is assembled to the panel 30 in a locked condition, the receiving space 11*a* in which the terminal piece 14 is received therein is aligned with the opening 31. By this arrangement, a complimentary connector (not shown) can be coupled to the connector 10 through the opening 31.

Figure 4:
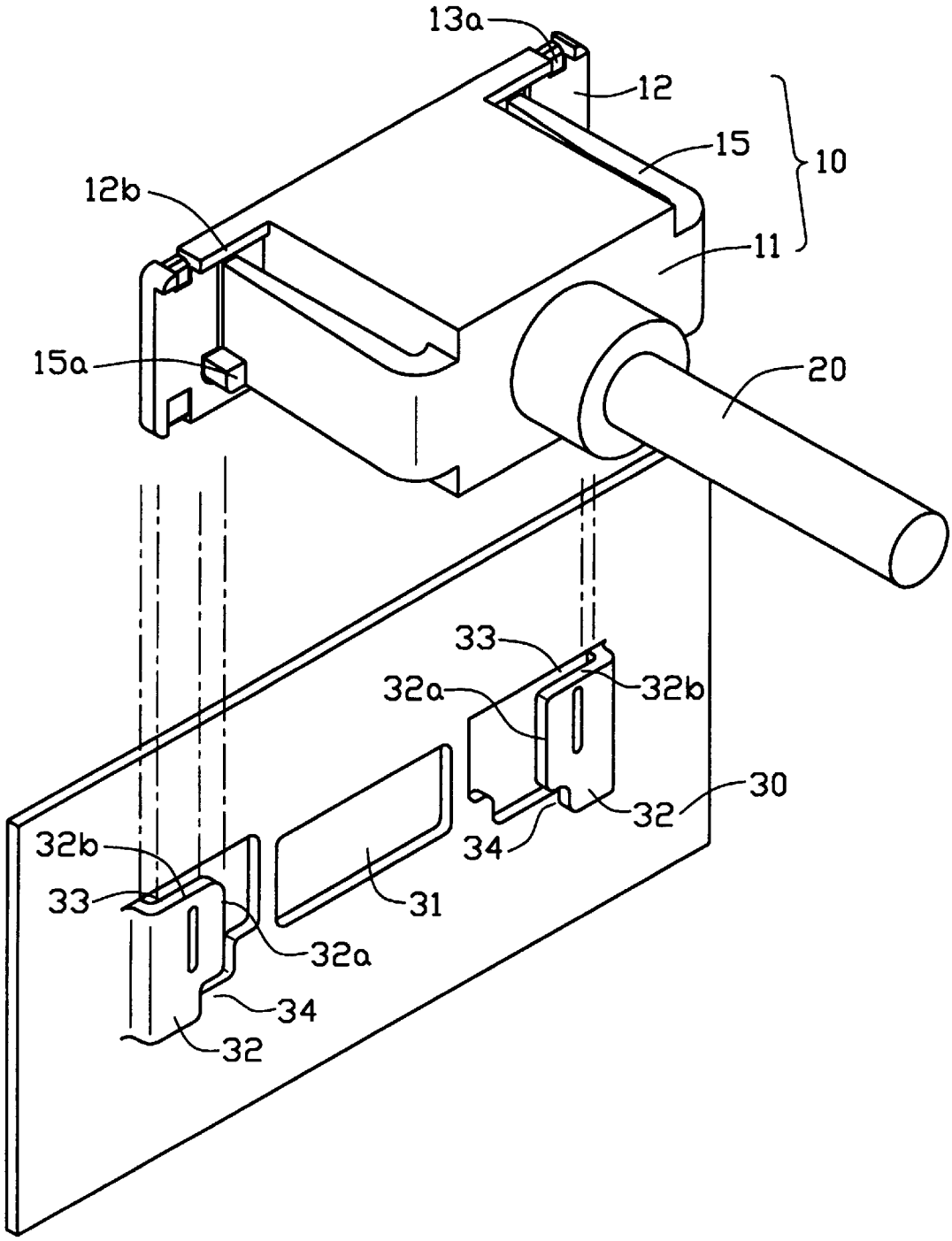
FIG. 4 is a perspective view showing the cable assembly of FIG. 1 is to be attached to a panel.
Figure 5:
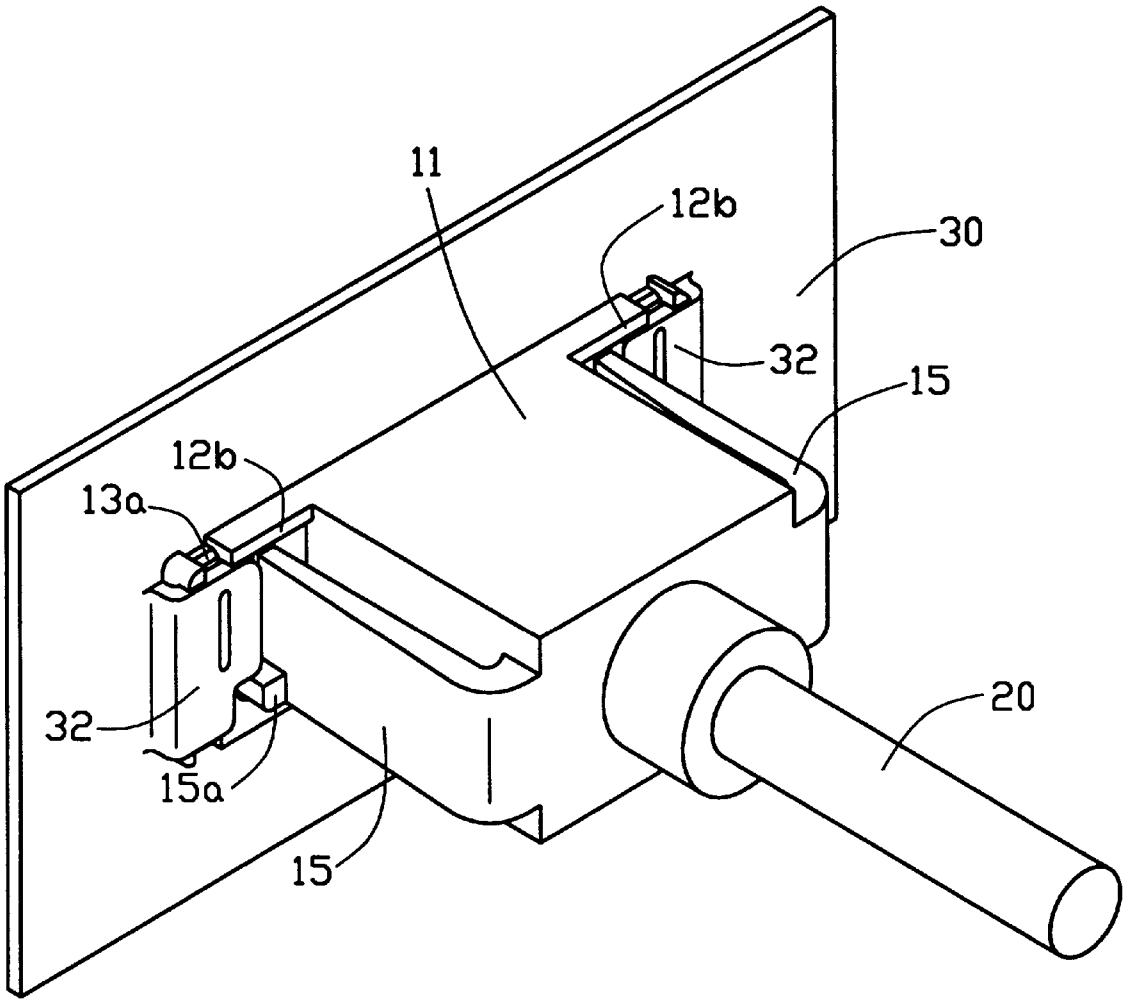
FIG. 5 is a perspective view showing the cable assembly is attached to the panel.
Figure 6:
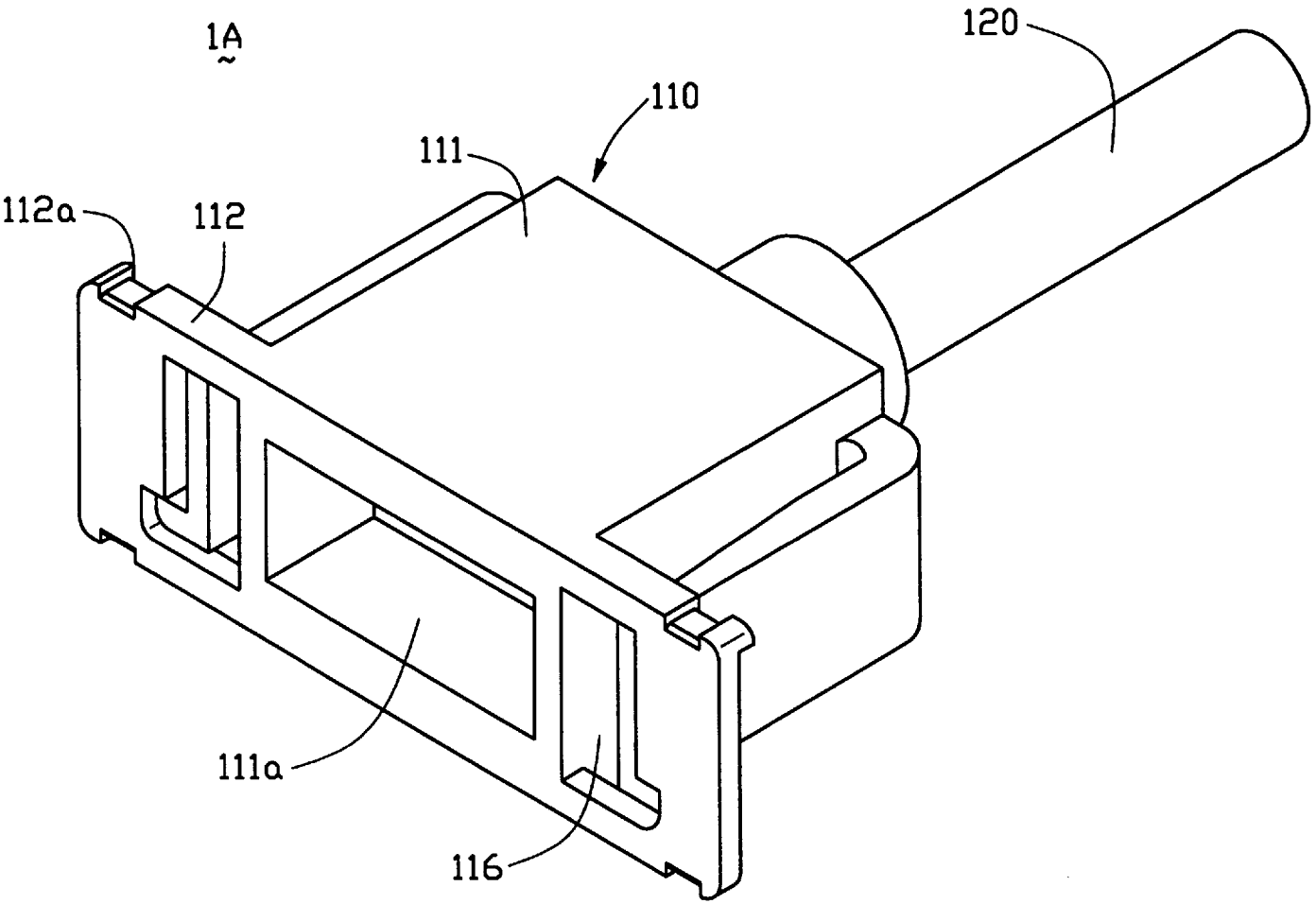
FIG. 6 is a perspective view of a cable assembly in accordance with a second embodiment of the present invention.
Figure 7:
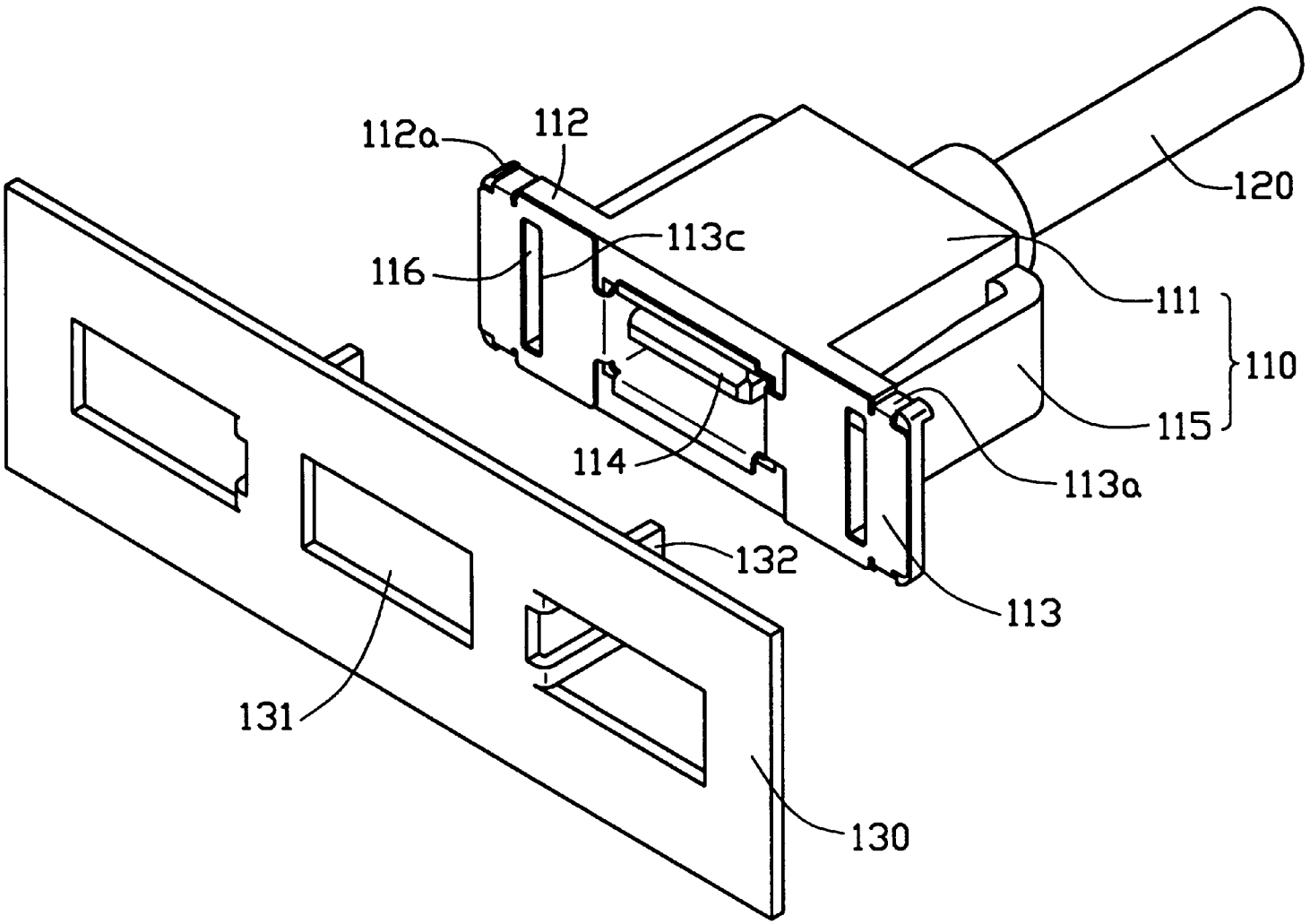
FIG. 7 is a perspective view showing the cable assembly is to be attached to a panel.
Figure 8:
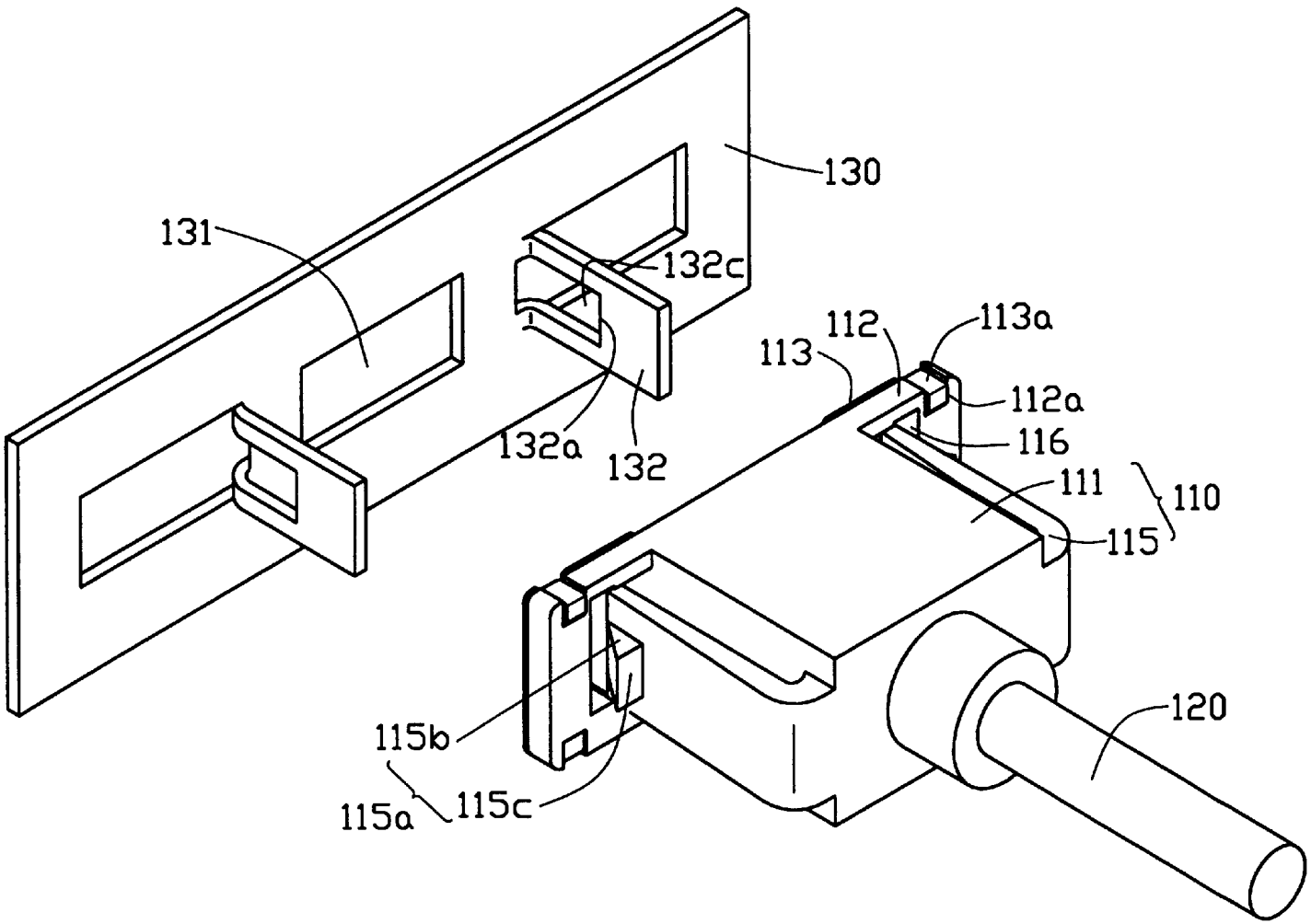
FIG. 8 is similar to FIG. 7 viewed from a reverse direction.
Figure 9:
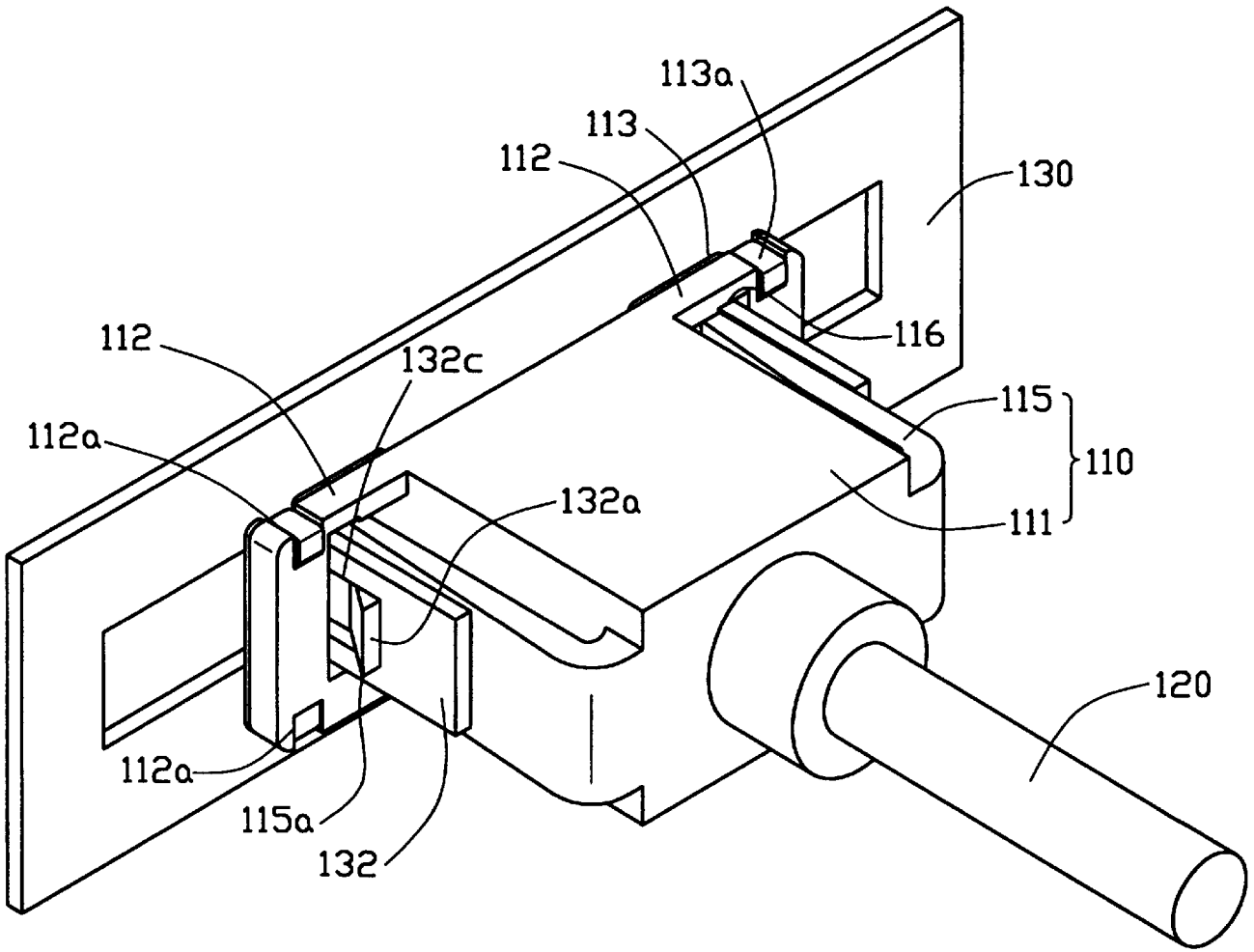
FIG. 9 is a perspective view showing the cable assembly is attached to the panel.

As clearly shown in FIGS. 4 and 5, when the connector assembly 1 is assembled to the panel 30, the locking arms 15 are pushed inward such that the locking bud 15*a* is shifted from a free end 32*a* of the retaining lug 32. As a result, the front flange 12 can slide into the gap 33 between the retaining lug 32 and the panel 30. When the cable assembly 1 reaches a final position, i.e. the stop 12*b* of the front flange 12 will abut against a top edge 32*b* of the retaining lug 32, and the locking arms 15 will pop outward such that the locking buds 15*a* are received in the cutout 34 of the retaining lug 32.

By this provision, the cable assembly 1 is fixedly attached to the panel 30 with the upward and backward movement being completely impaired. In addition, since the front flange 12 of the connector 10 is completely supported by the retaining lug 32, backward movement of the connector 11 during mating with the complimentary connector is completely eliminated.

Referring to FIGS. 6 to 9, a cable assembly 1A in accordance with a second embodiment of the present invention generally comprises a connector 110 and a cable 120 attached thereto. The connector 110 includes a housing 111 defining a receiving space 111*a* therein. The housing 111 further includes a front flange 112 extending transversely therefrom. A metal shell 113 is assembled to the housing 111. The metal shell 113 includes retaining tangs 113*a* fixedly clamped to notches 112*a* of the front flange 112. The metal shell 113 is also integrally integrated with a terminal piece 114 which is connected to the cable 120 (not detailedly shown).

A pair of locking arms 115 extends from the housing 111 in a rear-to-front direction. Each locking arm 115 further includes a locking bud 115*a* at a free end thereof. The locking bud 115*a* includes a leading surface 115*b* and an engaging surface 115*c*.

A computer enclosure panel 130 defines an opening 131 thereof. A pair of retaining lugs 132 extends from the panel 130. The retaining lugs 132 extend perpendicular to the panel 130. Each retaining lug 132 includes a retaining window 132*c* therein.

In the second embodiment, the front flange 112 is defined with a pair of passages 116 in alignment with the retaining lug 132. The metal shell 113 is also provided with a pair of slots 113*c* for extension of the retaining lugs 132.

When the cable assembly 1A is assembled to the panel 130, the receiving space 111*a* in which the terminal piece 114 is received therein is aligned with the opening 131. By this arrangement, a complimentary connector (not shown) can be coupled to the connector 110 through the opening 131.

In addition, when the cable assembly 1A is assembled to the panel 130, the retaining lugs 132 extends through the slots 113*c* and the passage 116. While the retaining lug 132 is contacting with the locking arm 115, the locking bud 115*a* will be pushed inward because of the leading plane 115*b* thereof. When the leading plane 115*b* slides over a front section of the retaining lug 132, the locking bud 115*a* will be received in the retaining window 132*c* with the engaging surface 115*c* popping out thereby abutting against to an edge 132*a* of the retaining window 132*c* to limit the rearward movement of the cable assembly 1A. As a result, the cable assembly 1 is firmly attached to the panel 130.

Again, the cable assembly 1A is fixedly attached to the panel 130 with the upward and backward movement being completely impaired. In addition, since the front flange 112 of the connector 110 is completely supported by the retaining lug 132, and backward movement of the connector 11 during mating with the complimentary connector is completely eliminated.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical system, comprising:

a computer enclosure panel defining an opening thereof, a pair of retaining lugs extending from edges of said opening;

a connector adapted to be assembled to said panel and including a housing with a mating portion aligned to said opening, said housing including a front flange portion received engaged with said retaining lugs when said connector is assembled to said panel;

interlocking means arranged between said panel and said housing, including a locking arm extending from said housing toward said panel, and a cutout formed on a free end of said retaining lug for engagement with a free end of said locking arm.

2. The electrical system as recited in claim 1, wherein said locking arm extends from a rear portion of said housing.

3. The electrical system as recited in claim 1, wherein said front flange forms a stop abutting against a top edge of said retaining lug when said connector is completely attached to said panel.

4. The electrical system as recited in claim 1, wherein said locking arm includes a locking bud received in said cutout when said connector is completely attached to said panel.

5. The electrical system as recited in claim 4, wherein said locking bud interferes with said free end of said retaining lug, and said front flange can slide into a gap defined between said retaining lugs and said panel only when said locking bud is moved away therefrom.

6. The electrical system as recited in claim 5, wherein said front flange of said connector can be released from said retaining lugs when said locking bud of said locking arm is disengaged with said cutout of said retaining lug.

7. The electrical system as recited in claim 1, wherein said front flange includes passages for receiving said retaining lugs therethrough.

8. The electrical system as recited in claim 1, wherein said retaining lug includes a retaining window.

9. The electrical system as recited in claim 8, wherein said locking arm includes a locking bud releasably engaged to said retaining window when said connector is assembled to said retaining lugs.

10. An assembly comprising:

a computer enclosure panel defining an opening, a pair of retaining lugs extending from two opposite side edges of the opening in an offset while parallel relation with the enclosure panel, a gap being defined between each of the lugs and the enclosure panel;

a connector including a housing defining a receiving space in alignment with the opening, a pair of front flanges laterally extending by two sides of the receiving space and dimensioned to be snugly received within the corresponding gaps, respectively;

a pair of resilient locking arms extending from the housing and deflectable in lateral directions; and a stop abutting against a top edge of each of said retaining lugs and a locking bud latchably engaged onto a bottom portion of each of said retaining lugs when the connector is in a locked condition with the panel; wherein at least one of said stop and said locking bud is integrally moveable along with the corresponding locking arms.

11. The assembly as recited in claim 10, wherein the stop is integrally formed with the housing while the locking bud is integrally formed with the corresponding locking arm, so that the connector can be downwardly assembled to the enclosure panel under a condition that the locking arms are first inwardly deflected to allow the front flanges to be downwardly inserted into the corresponding gaps, respectively, until the retaining lugs abut against the corresponding stops, and then the locking arms are deflected outwardly back to original positions to have the locking buds engage the corresponding retaining lugs, thus assuring retaining between the panel and the connector.

12. The assembly as recited in claim 10, wherein each of said locking arms extends from a rear portion of the housing toward the corresponding front flange.

13. An assembly comprising:

a computer enclosure panel defining an opening, a pair of retaining lugs rearwardly extending by two sides of the opening;

a connector including a housing defining a receiving space in alignment with the opening, a pair of front flanges laterally extending by two sides of the receiving space, each of said front flanges defining a passage extending in a front-to-back direction thereof; and a pair of resilient locking arms extending from the housing and deflectable in lateral directions, each of said locking arms including a locking bud at a free end thereof; wherein when assembled, the retaining lugs extend through the corresponding passages and latchably engage with the corresponding locking buds, respectively.

14. The assembly as recited in claim 13, wherein each of the locking arms extends from a rear portion of the housing toward the corresponding front flange.

15. The assembly as recited in claim 13, wherein each of said retaining lugs are spatially away from the opening in the lateral direction.

16. The assembly as recited in claim 13, wherein each of said retaining lugs includes a retaining window receiving the corresponding locking bud.

* * * * *